United States Patent [19]

Proctor

[11] Patent Number: 5,048,842

[45] Date of Patent: Sep. 17, 1991

[54] TRIVIA GAME SYSTEM

[76] Inventor: Angela B. Proctor, 3784 S. 610 East, Salt Lake City, Utah 84106

[21] Appl. No.: 322,682

[22] Filed: Mar. 13, 1989

[51] Int. Cl.[5] ..... A63F 3/00

[52] U.S. Cl. ..... 273/248; 273/446

[58] Field of Search ..... 273/249, 248, 1 GE, 273/1 GG, 258, 284

[56] References Cited

U.S. PATENT DOCUMENTS

| | | | |
|---|---|---|---|
| D. 33,057 | 8/1900 | Pennell . | |
| 3,565,440 | 2/1971 | Glass et al. | 273/1 GG |
| 3,649,022 | 3/1972 | Clark . | |
| 3,710,455 | 1/1973 | Liversidge et al. | 273/284 |
| 3,747,589 | 7/1973 | Harrison et al. | 273/1 GE |
| 3,926,438 | 12/1975 | Breslow . | |
| 3,984,106 | 10/1976 | White . | |
| 4,090,717 | 5/1978 | Rossetti | 273/302 |
| 4,121,823 | 10/1978 | McBride | 273/249 |
| 4,157,183 | 6/1979 | Meyer . | |
| 4,557,485 | 12/1985 | Lardon | 273/249 |
| 4,714,254 | 12/1987 | Calloway | 273/249 |
| 4,856,780 | 8/1989 | Begley et al. | 273/244 |

*Primary Examiner*—Edward M. Coven
*Assistant Examiner*—William M. Pierce
*Attorney, Agent, or Firm*—Thorpe, North & Western

[57] ABSTRACT

A game and game method involving recall of trivia information associated with commercial products, commercial slogans and personalities or characters associated with these products and slogans. Play of this game involves utilization of a playing board which is divided into individual sectors, with each sector including a movement track for a progress marker which identifies the winner of the game. A circular movement track is also provided to facilitate play or movement in a random manner and to serve as basis for selection of trivia questions and subject matter. Cards are provided with appropriate information and a request for response, and are coded to correspond to specific positions on the circular movement track. A timing device is provided for limiting the time period of response and for enabling other players to retrieve a removable element from the time and therefore entitle the player to interrupt normal rotation.

7 Claims, 1 Drawing Sheet

TRIVIA GAME SYSTEM

BACKGROUND OF THE INVENTION

1. Field of Invention

This invention pertains to game boards and methods involving multiple movement tracks wherein movement of player pieces may result in consequential movement of a second player piece on a second movement track. More specifically, the present invention relates to a trivia game directed toward media commercials, products and personalities wherein the players respond to trivia questions and progress toward a winning position on the game board as correct responses are given.

2. Prior Art

Trivia games continue to grow in popularity and cover subjects across a broad spectrum of information. Typical trivia playing format involves drawing a card which poses a trivia question, and generating some form of player movement on a playing board provided the response to the question is correct. A winning condition exists when the player has traversed a given player movement track. Differing categories of subject matter may be selected by random selection devices or by intentional choice of the player. Generally, the subject of such trivia games falls within historical information, broken into categories such as sports, theater, national histories and other names, events and places having some significance in past history.

A variety of movement tracks have been developed for board games and include circular or perimeter movement paths, as well as radial movement. For example, U.S. Pat. No. 3,649,022 by Clark, Jr. shows a game board that provides a variety of movement paths and playing positions which are randomly selected by throwing dice. Similarly, U.S. Pat. No. D33,057 illustrates a different embodiment of multiple movement tracks as part of a game board. U.S. Pat. No. 3,984,106 by White suggests the player option of utilizing game cards or dice to control movement options of players around a perimeter movement pattern, and also illustrates the conventional use of a timer for establishing a limited duration of time for player movement as part of each player's turn. The utilization of instruction cards to dictate various actions within the playing of a game is illustrated by U.S. Pat. No. 3,926,438 by Breslow, et al. Finally, U.S. Pat. No. 4,157,183 by Meyer illustrates a game apparatus wherein a retrieving mechanism is randomly actuated for retrieving player pieces from indexed position on a rotating platform. Collectively, these games illustrate various gaming sequences involving active play utilizing a game board, cards and exchange of information. Typically, such player involvement has not been applied to the field of trivia games, where primary game activities involve conditioning movement of player pieces along one track based on correct response to trivia questions.

OBJECTS AND SUMMARY OF THE INVENTION

It is an object of the present invention to provide a trivia game involving increased player activity and interplayer relationships during a normal gaming sequence.

A further object of the present invention is to provide a trivia game format wherein player dexterity is challenged, as well as ability to recall information.

A still further object of this invention is to provide a game board utilizing two interrelated movement tracks wherein one movement track provides for selection of trivia questions and the second movement track records correct responses as players progress toward a winning condition.

Yet another object of this invention is to provide a timing device which incorporates play and involvement in a random manner, based on player dexterity with hand movement.

A further object of this invention is to provide a trivia game system incorporating information from media commercials and embodying identification of commercial products, slogans and personalities.

These and other objects are realized in a game apparatus and method comprising a playing board divided into individual sectors for each player, with each sector having a player movement track with starting and terminal positions. A circular movement track is also provided for random movement of a player piece around the playing board in traversing manner by each individual sector. The circular movement track includes a plurality of movement positions which provide a numerical reference representing a potential number of moves of the progress marker toward the terminal position of the player movement track, wherein the progress move is contingent upon compliance with a requirement directed to a player landing upon the movement position. Means is provided for defining the action to be taken as part of the requirement. This disclosure also describes the use of a timing device for positioning on the playing board between players and including means for starting a timing sequence and for signaling completion of the timing sequence. The timing device also includes an exposed, removable element which can be grabbed and removed from the timing device by any player upon detection of the completion signal.

The present description identifies a specific application of the invention for use as part of a game method wherein the reference requirement includes questions directed to a player requiring identification of trivia information which has become associated with a famous product or personality, particularly in the context of media commercials. The player movement track is configured in the form of a tongue, as is the removal element in the timing device.

Other objects and features of the present invention be apparent to those skilled in the art based upon the following detailed description, taken in combination with the accompanying drawings.

DETAILED DESCRIPTION OF THE INVENTION

Figure 1:
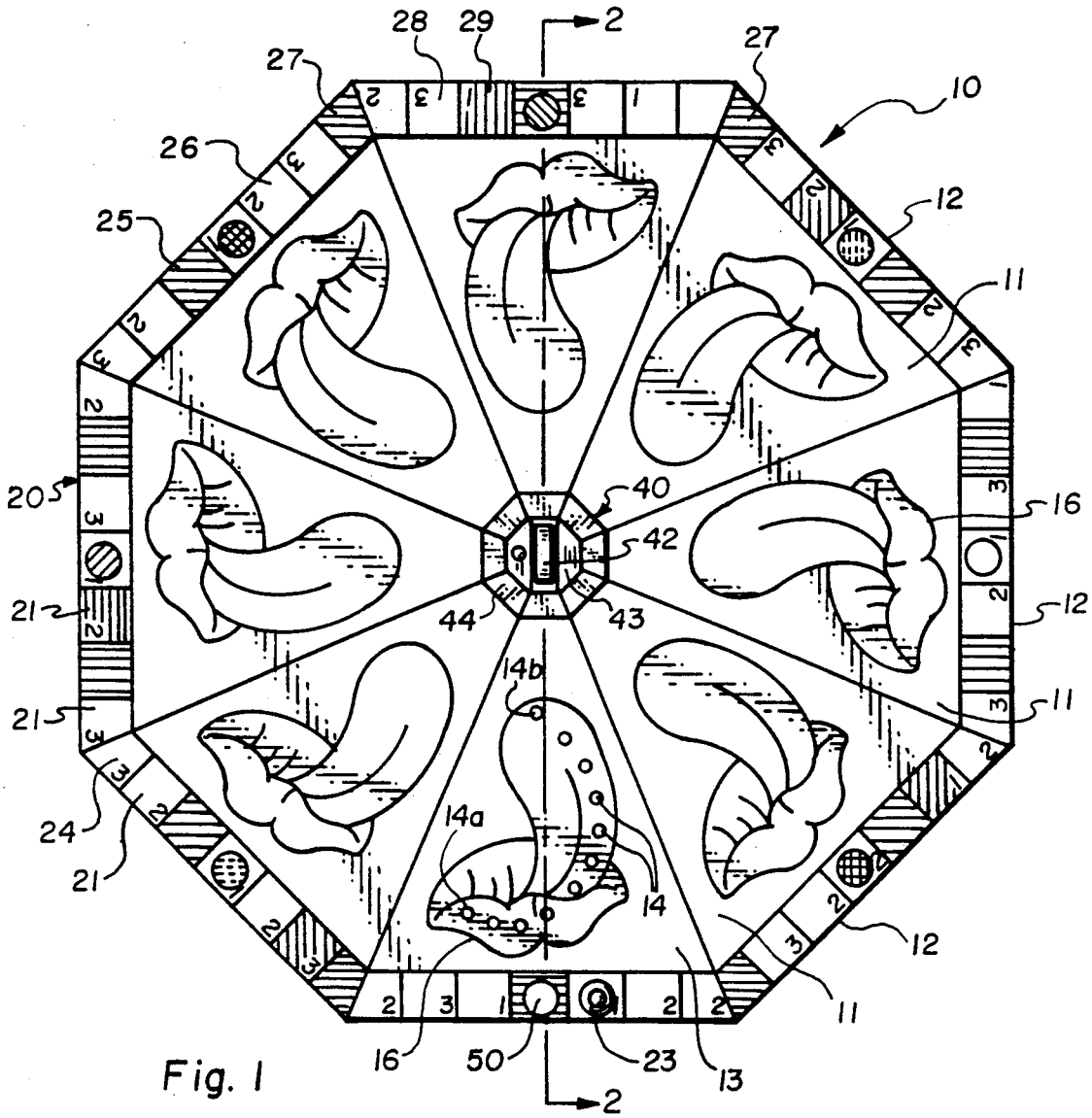
FIG. 1 shows a top plan view of a game board and timing device configured in one embodiment of the present invention.

Referring now to the drawings:

FIG. 1 shows a game board graphically configured to enable a game method involving identification of trivia information derived from media commercials for products or services. Each play by any given player involves the posing of a trivia question or piece of information relating to a product, its related slogan and/or an associated personality or character associated with this commercial. Where one of these items is identified, the player may be asked to identify either or both of the remaining categories of information relevant to this particular product, slogan or personality.

The questioning and response of such trivia information is controlled by player positions on the game board. A preferred embodiment of this game board 10 illustrates individual sectors 11 formed in pie-shape configuration which are provided for each player. Although eight sectors 11 are shown in the preferred embodiment, it will be apparent to those skilled in the art that any number of playing sectors could be provided, typically in some even number so that the game board is symmetrical. By utilizing a straight edge 12 to form a polyhedral shape, each player's sector is more easily distinguished and would presumably be the position from which the player addresses the playing board.

Figure 2:
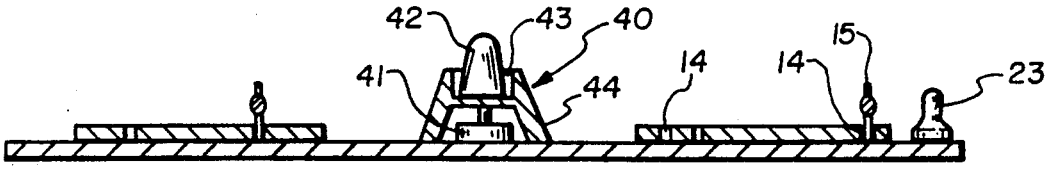
FIG. 2 shows a cross sectional view of the game board and timing device of FIG. 1, taken along the lines 2—2.

Each sector includes a player movement track, represented in sector 13 by an array of peg holes 14 which include a starting position 14*a* and an ending or terminal position 14*b*, and intermediate positions therebetween. As is shown in FIG. 2, these peg holes 14 provide a location for inserting a peg 15 which represents a progress marker to be moved sequentially the array of peg holes from the starting position 14*a* to a winning position at terminal peg hole 14*b*. Accordingly, the first player to succeed in reaching the terminal position on the player movement track 14 wins the game.

In the preferred embodiment illustrated, referred to under the trademark Tip-Of-The-Tongue, the player movement track 14 is located within a graphic representation of a tongue extending from a pair of lips. This graphic member 16 is placed within each of the sectors 12 and 13 to provide the player movement track 14 for uses previously explained. Although the graphic member 16 is illustrated with peg holes 14 only in sector 13, it is to be understood that each of the eight graphic members 16 would include the same array of peg holes forming the player movement track. Accordingly, each player is faced with the same number of peg movements to traverse from starting position 14*a* to terminal position 14*b*, despite the fact that only one movement track 14 is illustrated.

It will be apparent that other configurations for the player movement track 14 may be developed. The selected embodiment has been chosen because of its utilization of a tongue member in association with the specific game referred to as Tip-Of-The-Tongue associated with the challenge of recall of trivia information. A key function of the player movement track 14 is to provide a progress indicator which represents the comparable number of successful responses developed by a player as compared to competing players. It also incorporates random selections which develop unpredictability to the game outcome. Similarly, the position or orientation of the tongue member 16 could be shifted in numerous directions, in addition to the radial orientation illustrated in FIG. 1.

The playing board 10 further includes a circular movement track 20 which extends around the perimeter of the playing board. "Circular" refers to the closed-loop path provided by the track and not to a limited geometry. This circular movement track is made up of a plurality of movement positions 21 which extend in unending configuration around the playing board in traversing manner by each individual sector 12 or 13. Here again, although polyhedral shapes are shown in the illustrated embodiments, the respective movement positions could be circular or shaped in other geometric forms. The important feature is that this circular movement track provides for random movement of a player piece 23 in recurring manner around the board. Most of the movement positions 21 include a numeral 24 which will typically fall within the range of 1, 2 or 3, indicating a potential number of moves of the progress marker 15 toward the terminal position 14*b* of the player movement track. This numeral 24 is only a potential opportunity to move the progress member in view of the fact that the player must correctly answer a trivia question before actually being awarded the number of moves represented by the displayed numeral 24. In other words, movement of the progress marker is contingent upon compliance with a requirement directed to a player landing upon the particular movement position 21. In the present embodiment, the requirement to be complied with is the correct response to a trivia question relating to commercial products, slogans or characters. If the player were to correctly answer the trivia question, he would then move his progress marker through peg holes forward, corresponding to the numeral 3 in the identified position.

As indicated above, the circular movement track 20 provides a location for movement of player pieces 23 along a series of recurring movement positions which extend around a perimeter of the playing board. These movement positions are divided into a plurality of groups which may be commonly identified by a color, geometric symbols or other forms of identification. For example, player position 25 is a different color than player position 26. Furthermore, there are numerous other player positions 27 which have common color coding with player position 25 and which collectively belong to a group of player position sharing this common color identification. Similarly, player position 26 has common color coding with other positions of common color, represented by player position 28. Finally, a third set of colored player positions are identified by player position 29 and the similarly coded positions identified around the circular movement track 20.

The three groups of color-identified positions 27, 28 and 29 provide means for defining the type of trivia questions requiring player response, or whatever other required action one might wish to define as part of the playing sequence. One way to accomplish this is to provide some type of random selection process associated with the circular movement track and its various groups of colored movement positions. In the present embodiment, for example, player movement around the circular movement track may be based on the throw of a die or use of a spinner which identifies the number of movement positions to advance a player piece 23. The final landing place for the player piece will automatically select the group or color which is to be the basis for defining some action or reference requirement to be imposed on the player. By successfully answering or responding to this requirement, the player is then entitled to move the progress marker 15 a corresponding number of positions as are numerically defined on the movement position as has been previously discussed.

Figure 3:
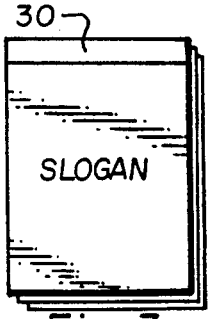
FIG. 3 shows a set of cards identifying a particular slogan.
Figure 4:
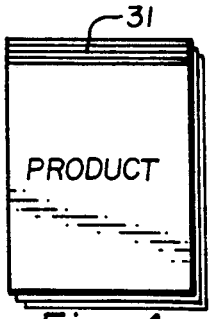
FIG. 4 shows a set of cards identifying a particular product.
Figure 5:
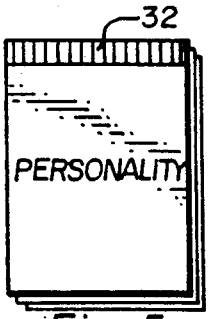
FIG. 5 shows a set of cards identifying a specific personality or character.

The compliance requirements in the present embodiment are set forth on cards as illustrated in FIGS. 3, 4 and 5. Each figure shows one set of cards comprising one of the groups and includes a color coding 30, 31 or 32 at the top of the card which identifies the group of corresponding color identification 27, 28 or 29 on the circular movement track. As an example, if a player has moved to the location identified by player piece 23, the corresponding color code is representative of the cards of FIG. 3 based on the common color code 30 with the color code of the player position. An individual player may therefore draw a card which will require him to state the commercial slogan for a given product or personality associated with the given product. This product might be shown on the opposite side of the card.

If, however, the player were to land on a player position colored in accordance with position 27, the drawn card would be from the FIG. 4 group representing products to be identified In this case, the reverse side of the card might show a personality who is typically linked with advertisements of the particular product or service, or may simply show a slogan which is part of the commercial advertisement. A player would then be required to state the identification of the product. Successful statement of this trivia information would entitle the player to the number of progress moves as is identified on the circular movement player position. A similar procedure would apply to the personality card identified in FIG. 5. These procedures are clarified in an example of actual play given hereafter. It will be apparent that many methods can be utilized to physically arrange these components into acceptable format. For example, the card may be contained in a box or container with a slotted access to withdraw whichever card is appropriate, based on the landing position of the player piece 23 of each player. Some means will be required for concealing any answer positioned on the respective cards and for providing sufficient identification to clarify the trivia information required.

When the present inventive concepts are applied to a trivia game, progress in the game can be facilitated by use of a timing device 40. The function of this device is to establish a given number of seconds as the response period for the player to complete the required action imposed by a particular player movement on the board. Continuing with the previous example as part of a trivia game for promotional commercials on products and services, a player may be allowed 30 seconds to respond to the request for information associated with one of the trivia cards illustrated in FIGS. 3, 4 or 5.

In the instant embodiment, the timer 40 is shown in its central position between the respective players and in an attached configuration to the game board 10. This timer includes a timing component or clock 41 which includes an alarm or other signal capable of alerting all players that the time for response has expired. Typically, such an alarm would be an audible signal such as a bell or buzzer which rings at the instant of expiration of time.

If the player has not correctly answered the inquiry for trivia information, the remaining players may then challenge to answer the question by reaching for a removable element 42 which can be readily grabbed and removed from the timing device 40. In FIG. 2, this removable element 42 is more clearly depicted in a tongue configuration corresponding to the game title of Tip-Of-The-Tongue (TM). It is positioned in a socket 43 which is configured to facilitate quick removal of the tongue 42 upon a player hearing the termination signal of the timing device. This slot 43 is formed within a base support 44 which houses the tongue and also encloses the timing device 41.

Although this timing device and tongue support are shown in a polyhedral configuration, it will be apparent that any number of geometric configurations could be adapted to accomplish the objectives of this aspect of the invention. The key element is utilization of a timing device in combination with a removable element which further generates random progress within the game by allowing a player who successfully retrieves the removable element to answer the trivia question and gain the benefit of any progress marker movement if answered correctly. Obviously, the turn would then revert to the next person in line following that person whose inaccurate answer or failure to answer enabled the different player to retrieve the time and pose the correct response.

As an illustration of the general game method embodied in these inventive concepts, the following steps are illustrative. First, the game is played in accordance with the present invention where a player randomly moves his or her player piece between movement positions around the circular movement track on a playing board. This movement enables the selection of a trivia question based on the particular movement position occupied by the player. If the player correctly responds, he is entitled to move his progress marker along a second movement track 14 from a starting position toward a terminal position. If the player incorrectly answers, play may move to the next player or an interrupt sequence can arise based on the use of the timing device.

If the timing device is utilized, the timing period is established. Upon having the trivia question posed, a player activates a timing sequence and the player having the current turn then has this time duration to get an accurate response. A signal is activated upon completion of the time period noting expiration of the time for response. Upon occurrence of the signal, any other player other than that person who was presently taking a turn is entitled to grab for a removable element associated with the timing device. That player who successfully retrieves the removable element is awarded the right to answer the question and gain the marker movement progress, or receives some other benefit. This format of play continues serially through the respective players until one of the players moves his progress marker to the terminal position and wins the game.

These specific inventive concepts can be applied to any form of trivia game by following the following steps. First, a player selects a trivia question relating to identification of a single subject from a group of subjects which include media commercials, commercial products and famous characters associated with a particular commercial. A question or required action is then posed to the individual player wherein one of the subjects is identified with an inquiry to the player to identify one or both of the remaining subjects associated with a given commercial or commercial product. The player response must occur within a predetermined time period, with the correct response generating some progress on that player's part toward winning the game.

These general inventive steps are embodied in the specific example relating to the game shown in FIGS. 1 through 5. The object of this game is to be the first player to reach the tip of the tongue, identified by terminal peg position 14*b*. Each player starts in an initial peg position 14*a*, defining the bounds of the player movement track. This track is positioned in a sector referred to as the player's home base which typically will be in front of the player's seated position. Each sector may be uniquely colored with a color corresponding to the player's movement piece so that player identification can be monitored.

The playing piece for each sector is initially positioned at a starting position 50, referred to as the home base circle. A sponge tongue or other form of removable element 42 is positioned in the timer slot 43. Each player positions a marker peg 15 at the starting location 15*a* within the movement track. Finally, slogan, product and personality cards are organized so that a player can select one of these cards based on a landing position of his player piece. With these assembled components, play is now ready to commence.

The first player rolls the die to determine the number of movement positions his player piece will move. Once the player piece has been moved to a new location, the player identifies the corresponding color of his movement position with that of the cards shown in FIGS. 3, 4 and 5. The player selects an appropriate card based on its corresponding color code 30, 31 or 32 with that color code shown on the landing position of the player, and the timing device 30 is activated. The player now has 30 seconds to answer the question posed on a particular player card. For example, if the player lands on the color code corresponding to slogan cards 30, the slogan card is drawn. The player then identifies the specific inquiry, which may be illustration of a product or identification of a personality, with the required action game identification of the corresponding slogan associated with a related commercial advertisement. For example, the player may draw a card which states the personality name Dig'em, or the product identification Sugar Smacks (TM) cereal. The player would then be required to state the slogan associated with these two common commercial elements, which would be, "Give me a smack and I'll smack you back." Having properly stated the slogan, the player moves his progress marker from starting position 14*a* to a new peg position corresponding to the numeral shown on the player movement position within the circular track.

If, on the other hand, the player was unable to recall the slogan associated with the personality or product, the timing device would eventually signal expiration of the time period. Obviously, the remaining players are alert to hear that signal and immediately attempt to grab the tongue 42 from its seated position at the timing device 40. That player which successfully retrieves the tongue is entitled to answer the question and take the corresponding marker movement, or receive some other benefit. Play then resumes with normal rotation.

Other features can be included within the circular movement track to add variety and unpredictable events to the game sequence. For example, if a player lands on their home circle, they may automatically score certain points or get the benefit of marker movement. Other player movement positions may include penalties such as movement of your progress marker in a reverse direction, toward the starting position. Other variations will be apparent to those skilled in the art. Accordingly, it is to be understood that the foregoing description is illustrative and is not to be considered limiting except by the following claims.

I claim:

1. A game including game apparatus comprising:

a playing board divided into individual sectors for each player, each sector having a player movement track including a starting position, a terminal position and a plurality of intermediate positions therebetween and wherein the game is won by a player who first moves a progress marker from the starting position to the terminal position;

said board further including a movement track for random movement of a player piece, said track extending in unending configuration around the playing board in traversing manner by each individual sector, said movement track comprising a plurality of movement positions which include a numerical reference representing a potential number of moves of the progress marker toward the terminal position of the player movement track, said moves of the progress marker being contingent upon compliance with an instructional requirement directed to a player landing upon the movement position;

means associated with the movement track for defining instructional requirement defining action to be taken by the landing player which, if successfully accomplished, entitles the landing player to move the progress marker; and a timing device including means for starting a timing sequence and for signaling completion of the timing sequence, said timing device further including an external holding compartment and a removable element, said removable element being supported within the compartment with most of said removable element being exposed to open view of the players and being manually removable from the timing device by any player after detection of the completion signal.

2. A game as defined in claim 1, wherein the circular movement track comprises a recurring series of movement positions extending around a perimeter of the playing board, said movement positions being divided into a plurality of groups which respectively correspond to a plurality of compliance requirements of differing nature to be imposed in response to player random movement around the movement track, the selection of a specific requirement being accomplished by a player landing upon the movement position belonging to a corresponding group.

3. A game as defined in claim 2, wherein the divided groups of movement positions are identified by a unique color common to each movement position applicable to the group, said game further comprising groups of cards having corresponding unique color common to each card belonging to a given group, said movement position providing instruction means requiring the player to select a card from the card group which corresponds to the color of the selected card when a player's random movement piece lands on a movement position having common color with the card.

4. A game as defined in claim 1, further comprising a plurality of printed cards which include the instructional requirement printed thereon in the form of questions directed to the player, said questions requiring identification of trivia information which has become associated with a famous product or personality.

5. A game as defined in claim 4, further comprising a plurality of sets of cards which include questions printed thereon representing differing categories identifying (i) a media commercial slogan (ii) a related product or service and (iii) a famous personality associated therewith, said instructional requirement being set forth in an instructional means which provides at least one of the three categories as given information, and requests a response to name at least one of the remaining categories of information.

6. A game as defined in claim 1, wherein said timing device is centrally positioned on the playing board.

7. A game as defined in claim 1, wherein the player movement track is contained within a graphic boundary which is configured in the form of a tongue.

* * * * *